United States Patent [19]

Plowman

[11] Patent Number: 4,590,706

[45] Date of Patent: May 27, 1986

[54] PROTECTIVE DEVICE FOR PANES OF WINDOWS AND GLASS DOORS

[75] Inventor: John S. Plowman, Nambour, Australia

[73] Assignee: Kinpar Pty. Ltd., Queensland, Australia

[21] Appl. No.: 629,577

[22] Filed: Jul. 11, 1984

[51] Int. Cl.[4] ..... E06B 3/68

[52] U.S. Cl. ..... 49/57

[58] Field of Search ..... 49/57, 70; 248/200.1; 52/204, 828

[56] References Cited

U.S. PATENT DOCUMENTS 2,794,217 6/1957 Croft ..... 49/57 X
2,994,285 8/1961 Dunlap ..... 49/57 X
4,325,203 4/1982 Wicks ..... 49/57
4,520,592 6/1985 Holloway ..... 49/396

*Primary Examiner*—Kenneth Downey
*Attorney, Agent, or Firm*—Larson and Taylor

[57] ABSTRACT

A device for protecting panes of windows and glass doors consists of a beam which may be removably engaged in mounting brackets at the sides of, or above and below, the pane, so that the beam is parallel to and spaced from the pane, one or more pressure pads being mounted on the beam for movement to an operative position against, and applying pressure to the inside face of the pane to counteract vibration or flutter of the pane. The beam may have a pelmet fascia fixed to it and, when not in use, may be supported inconspicuously above the window or door.

4 Claims, 5 Drawing Figures

PROTECTIVE DEVICE FOR PANES OF WINDOWS AND GLASS DOORS

BACKGROUND OF THE INVENTION (1) Field of the Invention

This invention relates to a protective device for panes of windows and glass doors.

(2) Prior Art

The very strong wind gusts experienced in cyclonic conditions frequently cause shattering of windows and glass doors, often by inducing high vibration or "fluttering" of the glass leading ultimately to its destruction, or by the high pressures to which the glass is subjected, or from the impact of even quite small particles of flying debris. Any such breakage may, of course, result in extensive damage to the interior of the building from the wind or from flooding, as well as causing serious injury to people in the affected building.

The present invention has been devised with the general object of providing a protective device which can be quickly and easily applied to glass areas at risk when severe wind conditions are experienced or expected, and which will very materially reduce the likelihood of their being broken. Other objects achievable in preferred embodiments of the invention are to provide such a device which is simple and economical to manufacture and which may be stored, when not in use, in a neat and unobstrusive manner, conveniently available for speedy application to a window or door when required.

SUMMARY OF THE INVENTION

According to the invention, a protective device for panes of windows and glass doors includes a beam, mounting means being provided for removably mounting the beam substantially parallel to and spaced from the inside face of a window or door pane. A pressure pad is mounted on the beam in such a way that it can be moved to an operative position against, and applying pressure to, the inside face of the pane. A device for application to a window of several panes will normally have a corresponding number of pressure pads individually movably mounted on the beam. The beam may have a pelmet fascia fixed in front of it and, when disengaged from the mounting means, be adapted to be removably fitted above the window serving as the main part of a window pelmet and conveniently available for use as a protective device whenever required. Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

Figure 1:
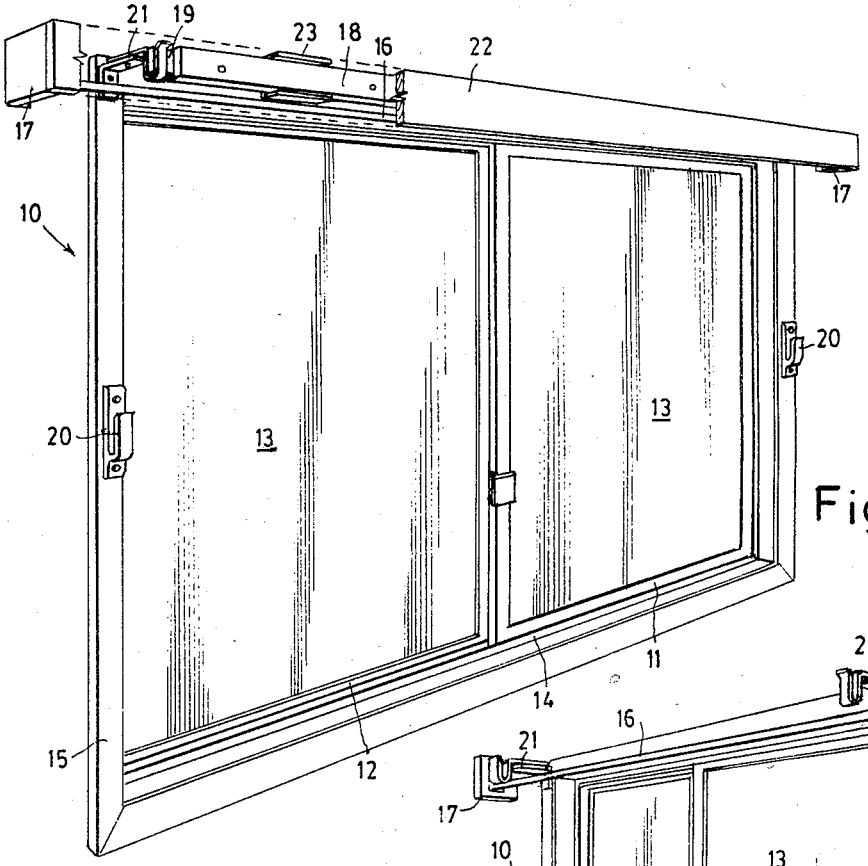
FIG. 1 is a partly broken-away view of a protective device according to the invention, in its stored position above a window.

In the drawings, the window assembly 10 is of well-known domestic metal-framed type with a sliding sash 11 and a fixed sash 12, each with a glass pane 13 and mounted in a double-channelled metal frame 14 fixed in a window opening in an exterior wall of a building and surrounded, on the inside, by a timber architrave 15. A curtain rail 16 is mounted between a pair of pelmet ends 17 fixed to the wall in which the window assembly is installed.

The protective device includes a beam 18 which may suitably be a length of rectangular-section metal extrusion, its ends being closed by metal plugs each of which has an outwardly extending projection, of about the same depth as the beam but of lesser width, to form a tang 19.

Figure 2:
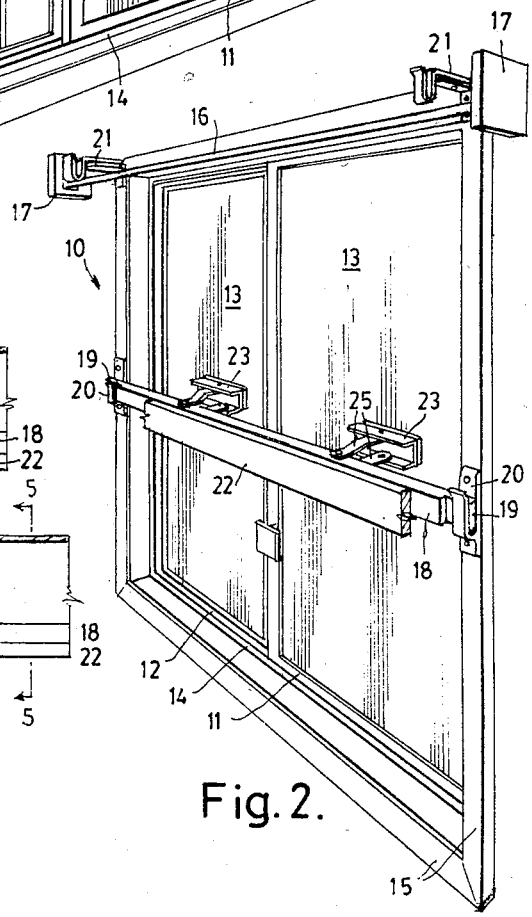
FIG. 2 is a partly broken-away perspective view of the device applied to the window in its operative position.

The beam 18 may be supported in its operative position, extending across the middle parts of the window sashes 11 and 12 as shown in FIG. 2, by engaging its two tangs 19 in a pair of architrave brackets 20 firmly fixed to the sides of the architrave 15.

When the protective device is not required for use, it may be conveniently and unobstrusively stored above the window sashes, as shown in FIG. 1, by engaging its tangs 19 in a pair of carrier brackets 21 fixed to the tops of the architrave sides; and the protective device so stored is concealed by a pelmet fascia 22 fixed, as by screws through the beam, to the front of the beam, and extending downwardly below it, concealing also the curtain rod 16. The pelmet fascia 22 extends beyond both ends of the beam 18, and when the protective device is supported in its stored position by the carrier brackets 21, the ends of the fascia abut removably against the pelmet ends 17 fixed to the wall.

Figure 3:
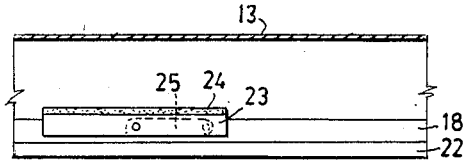
FIG. 3 is a detail plan view of a part of the device showing one of the pressure pads in its folded position.

The protective device includes a pair of pressure pads 23 each consisting of a section of metal channel to the web of which there is adhered a facing 24 of a resiliently deformable material such as rubber or felt. The two flanges of each pressure pad channel are connected to the top and bottom of the beam 18 by a pair of swing links 25, the parts being so made and arranged that each pressure pad 23 may be brought to folded position, the web of its channel being closely adjacent to the front of the beam 18, as shown particularly in FIG. 3, or to its extended position, the links 25 being swung through right angles to bring them perpendicular to the beam 18 and the pressure pad 23.

Figure 4:
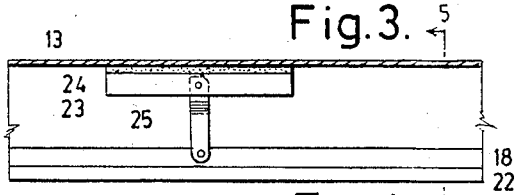
FIG. 4 is a view similar to FIG. 3 but with the pressure pad advanced to its operative position.
Figure 5:
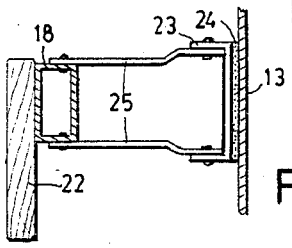
FIG. 5 is a sectional view, to larger scale, taken along the line 5—5 in FIG. 4.

As shown in FIG. 1, the pressure pads 23 are folded when the protective device is in its stored position. When the device is required for use in its protective function, it is lifted so that its tangs 19 are disengaged from the carrier brackets 21, and is lowered to engage its tangs instead in the architrave brackets 20. The pressure pads 23 are then swung to their extended positions, in which their resilient facings 24 are brought firmly against the middle parts of the panes 13 of the two sashes 11 and 12, as shown in FIGS. 4 and 5, applying pressure to the glass. The pairs of links 25 for the two pressure pads 23 of the protective device for a sliding sash window of the type illustrated are cut to differetial lengths so as to be capable of applying the required pressure to the panes 13 of both the sliding sash 11 and the fixed sash 12.

When the protective device is in its stored position it will be completely concealed behind the pelmet fascia and the architrave brackets 20 will normally be concealed behind curtains (not shown) hung from the curtain rail 16. At the same time, the device may be quickly and easily installed to perform its protective function, in which it will be found to be very effective, the stressing of the glass panes 13 by the pressure pads 23 eliminating or very materially reducing "flutter" of the glass, resisting direct wind pressure, and bracing the panes against impact of flying debris.

Protective devices according to the invention may be made to suit most standardised types of windows, and glass doors with or without adjacent fixed glass door sections. In some cases it may be preferred that the device, in its operative position, should be arranged vertically rather than horizontally, in which case the architrave brackets 20 may be installed at top and bottom of the glass section or, in the case of a glass door, the lower tang of a beam may be engaged in a socket in the floor. A protective device for a window of glass louvre blades may be made for vertical operative installation with a single elongated pressure pad for applying pressure simultaneously to all of the blades. Each pressure pad of any of the embodiments may be connected to the beam of an adjustable link instead of a pair of links cut to the required length. For example, the beam may be a channel instead of a box-section, the pressure pad being a deeper channel, the two being connected by a screw-threadedly or otherwise adjustable link pivoted to both. Window or door panes stressed against vibration or impact by the protective view may still be shattered by a large piece of flying debris, and it may be preferred, therefore, to incorporate in the device a visual and/or audible alarm (not shown) brought into operation by a sensor in any or each of the protective pads upon the sudden reduction in pressure at the pad or pads. The protective device may therefore serve also as a security device to give warning of intentional breakage of a pane of a window or door.

I claim:

1. A protective device for panes of windows and glass doors including:

a beam, mounting means for removably mounting the beam substantially parallel to and spaced from the inside face of the pane, a pressure pad mounted on the beam for movement to an operative position against, and applying pressure to, the inside face of the pane, a pelmet fascia secured to the rear or inside face of the beam, and means for releasably supporting the beam in a stored position above a window or door.

2. A protective device according to claim 1 wherein the mounting means include:

a pair of mounting brackets for fixture to opposite sides of a window or glass door, and tangs at the ends of the beam for releasable engagement in the mounting brackets.

3. A protective device for panes of windows and glass doors including:

a beam, mounting means for removably mounting the beam substantially parallel to and spaced from the inside face of the pane, a pressure pad mounted on the beam for movement to an operative position against, and applying pressure to, the inside face of the pane, and means connecting said pressure pad to said beam, said connecting means comprising a swing link member pivotably connected to said pressure pad and to said beam, said swing link member being pivotable between an operative position in which said swing link member is perpendicular to said beam and a stored position in which said pressure pad is adjacent to said beam.

4. A protective device according to claim 6 wherein the mounting means include:

a pair of mounting brackets for fixture to opposite sides of a window or glass door, and tangs at the ends of the beam for releasable engagement in the mounting brackets.

* * * * *